US007408479B2

(12) United States Patent
Johnson

(10) Patent No.: US 7,408,479 B2
(45) Date of Patent: Aug. 5, 2008

(54) TRAFFIC DETECTION AND SIGNAL SYSTEM AND METHOD THEREFOR

(75) Inventor: Andrew P. Johnson, Waterford, MI (US)

(73) Assignee: Door-Man Manufacturing Company, Auburn Hills, MI (US)

( * ) Notice: Subject to any disclaimer, the term of this patent is extended or adjusted under 35 U.S.C. 154(b) by 153 days.

(21) Appl. No.: 10/921,719

(22) Filed: Aug. 19, 2004

(65) Prior Publication Data

US 2005/0151670 A1 Jul. 14, 2005

Related U.S. Application Data

(60) Provisional application No. 60/496,364, filed on Aug. 19, 2003.

(51) Int. Cl.
*G08G 1/07* (2006.01)

(52) U.S. Cl. ..... 340/917; 340/916; 340/686.6

(58) Field of Classification Search ..... 340/541, 340/686.6, 540–9, 916–917, 906; 250/221
See application file for complete search history.

(56) References Cited

U.S. PATENT DOCUMENTS 4,115,757 A * 9/1978 Blahunka ..... 340/906
5,448,219 A 9/1995 Yoshikawa et al.
5,572,202 A * 11/1996 Regel et al. ..... 340/917
5,777,564 A 7/1998 Jones
5,917,431 A * 6/1999 Sanada et al. ..... 340/907
6,005,491 A 12/1999 Kopchak et al.
6,072,407 A 6/2000 Shin
6,144,317 A 11/2000 Sims
6,326,903 B1 12/2001 Gross et al.
6,762,689 B2 7/2004 Dechape
2004/0183694 A1 * 9/2004 Bauer ..... 340/907

* cited by examiner

*Primary Examiner*—Davetta W. Goins
*Assistant Examiner*—Hongmin Fan
(74) *Attorney, Agent, or Firm*—Bliss McGlynn, P.C.

(57) ABSTRACT

A traffic detection and signal system for pathways within an industrial work environment and method therefor includes at least one sensor positioned to detect objects approaching a pathway intersection and at least one visual indicator electronically linked to the at least one sensor to visually indicate that an object is approaching. The system further includes a controller electronically coupled to the at least one sensor and visual indicator to receive a signal that an object is approaching a pathway intersection and transmit a signal to energize the at least one visual indicator.

19 Claims, 3 Drawing Sheets

TRAFFIC DETECTION AND SIGNAL SYSTEM AND METHOD THEREFOR

CROSS-REFERENCE TO RELATED APPLICATION(S)

The present invention claims the priority date of copending U.S. Provisional Patent Application Ser. No. 60/496,364, filed Aug. 19, 2003.

BACKGROUND OF THE INVENTION

1. Field of the Invention

The present invention relates generally to traffic detecting and signaling and, more particularly, to a traffic detection and signal system and method therefor.

2. Description of the Related Art

Within an industrial work environment, it is known that man and machine are often in close proximity to each other. Further, within an industrial work environment such as warehouses, plants, factories, lumber yards and shipping/loading docks, there exist a series of pathways having intersections and/or blind corners through which large objects such as machinery, forklifts, and loaders travel during operation.

Given the vision-obscured pathway intersections within industrial work environments, extreme caution should be taken by both persons and operators of large objects when traveling through such intersections, for the likelihood of severe damage to both person and large object may be great where another large object or person is approaching the same intersection from a different direction. Accordingly, when the operator of a large object is approaching one of these intersections, it is common to invoke an audible signal to warn any person or machine approaching the same intersection of its ensuing presence. However, the operator may not always practice this customary signaling. Further, the audible level of the surrounding workplace environment might be at such a high level that the customary audible signal may not be readily received by surrounding operators or persons.

Therefore, it is desirable to a system and method to detect when an object is approaching an intersection and provides a visual display to persons and operators of large objects operators adjacent the same intersection of an object's approach. Therefore, there is a need in the art to provide a system and method that meets this desire.

SUMMARY OF THE INVENTION

It is, therefore, one object of the present invention to provide a traffic detection and signal system for pathways within an industrial work environment.

It is another object of the present invention to provide a traffic detection and signal system that can detect each individual pathway when an object is approaching a pathway intersection within an industrial work environment.

It is yet another object of the present invention to provide a traffic detection and signal system to visually indicate the presence of an object approaching each individual pathway intersection within an industrial work environment.

It is still another object of the present invention to provide a traffic detection and signal system that distinguishes between pedestrians and large objects approaching a pathway intersection.

It is still another object of the present invention to provide a method for detecting an object approaching pathway intersection within an industrial work environment and signaling to other directions toward the pathway intersection that an object is approaching.

To achieve the foregoing objects, the present invention is a traffic detection and signal system for pathways within an industrial work environment. The traffic detection and signal system includes at least one sensor positioned to detect objects approaching a pathway intersection within an industrial work environment. The traffic detection and signal system also includes at least one visual indicator electronically linked to the at least one sensor to visually indicate that an object is approaching a pathway intersection from another direction. The traffic detection and signal system further includes a controller electronically coupled to the at least one sensor and the at least one visual indicator to receive a signal from the at least one sensor that an object is approaching a pathway intersection and to transmit a signal to the at least one visual indicator.

Additionally, the present invention is a method for sensing and detecting an object approaching an intersection within an industrial work environment. The method includes the steps of sensing for moving objects approaching a pathway intersection within a predetermined sensing range and detecting a moving object greater than the size of an average human being approaching a pathway intersection within a predetermined detection field. The method also includes the step of receiving a signal from at least one sensor positioned toward a first direction and transmitting a signal from the controller to activate at least one visual indicator positioned toward directions other than the first direction until the moving object is no longer approaching the pathway intersection. Upon receipt of the signal, the visual indicator energizes and provides a visual indication that an object is approaching a pathway intersection.

One advantage of the present invention is that a traffic detection and signal system for pathways within industrial work environments is provided. Another advantage of the present invention is that a traffic detection and signal system for pathways within industrial work environments is provided having a plurality of sensors to sense the presence of an object approaching an intersection. Yet another advantage of the present invention is that a traffic detection and signal system for pathways within industrial work environments is provided having a plurality of visual indicators adapted to visually indicate that an object is approaching an intersection. Still another advantage of the present invention is that a traffic detection and signal system for pathways within industrial work environments is provided having a controller to receive a signal from the sensors and transmit a signal to the visual indicators.

Other objects, features, and advantages of the present invention will be readily appreciated, as the same becomes better understood, after reading the subsequent description when taken in conjunction with the accompanying drawings.

DESCRIPTION OF THE PREFERRED EMBODIMENT(S)

Figure 1:
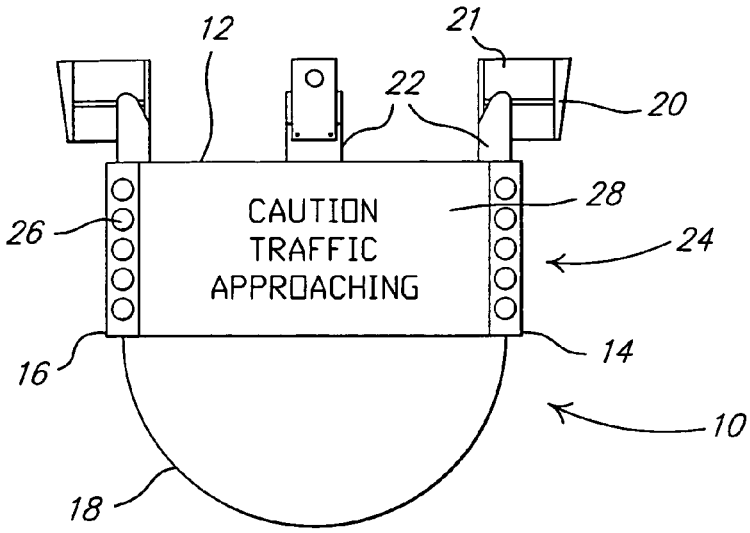
FIG. 1 is an elevational view of a traffic detection and signal system, according to the present invention.
Figure 5A:
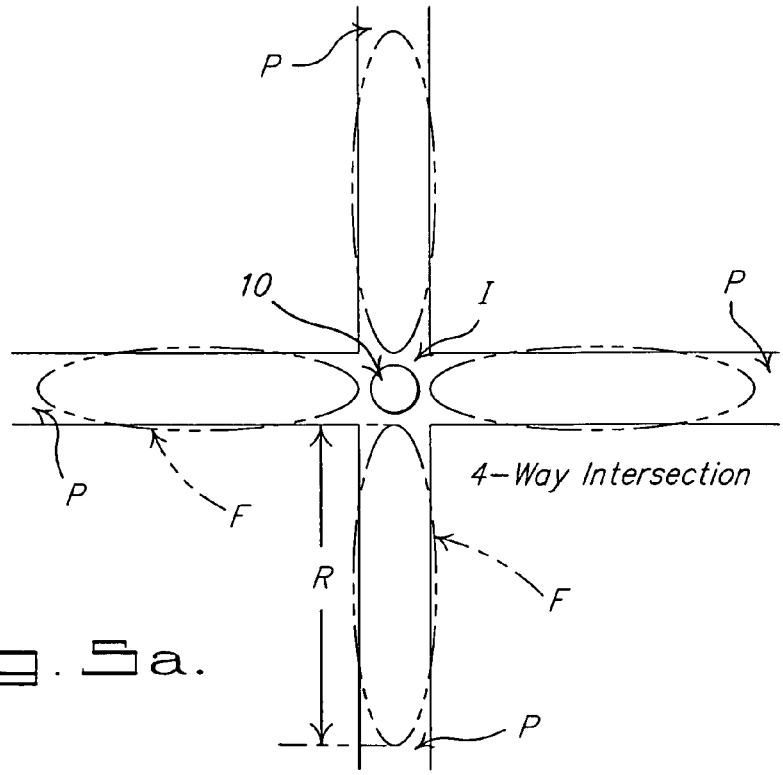
FIG. 5A is a plan view of a sensor field of detection and signal range of the traffic detection and signal system of FIG. 1.

Referring now to the drawings, and in particular FIG. 1, one embodiment of a traffic detection and signal system 10 is shown for pathways within industrial work environments. The traffic detection and signal system 10 is used for regulating the traffic that occurs along pathways (P) within an industrial environment that include intersections (I), where cross-bound and/or oncoming traffic remains visually obscured until immediately adjacent or disposed within an intersection (I) as illustrated in FIG. 5A. By way of example, industrial environments of the type suitable for the system 10 of the present invention include factories, warehouses, shipping/loading docks, and lumberyards. It should be appreciated that the system 10 may be employed within any industrial environment where large objects such as machines, forklifts, loaders, skid-steers, or the like traverse pathways (P) having intersections (I). It should also be appreciated that while the system 10 is referred to for application at pathway intersections (I) within industrial work environments, the system 10 may be employed at any location within industrial work environments where vision along a pathway (P) may be obscured. By way of example, the system 10 may be employed along blind corners of pathways (P) within industrial work environments to detect objects. It should further be appreciated that while the system 10 is intended to detect objects approaching an intersection (I), it may be adjusted to detect only large objects, to be described, such as forklifts, loaders, skid-steers, or the like.

Figure 2:
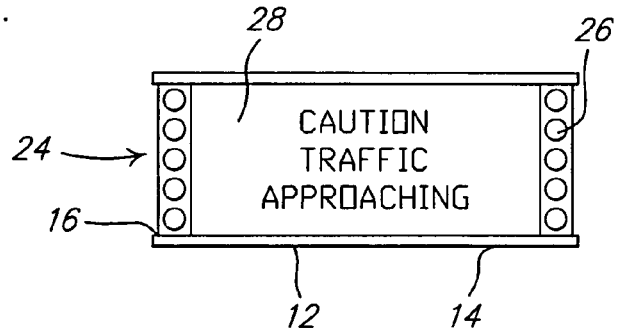
FIG. 2 is an elevational view of a visual indicator of the traffic detection and signal system of FIG. 1.
Figure 3:
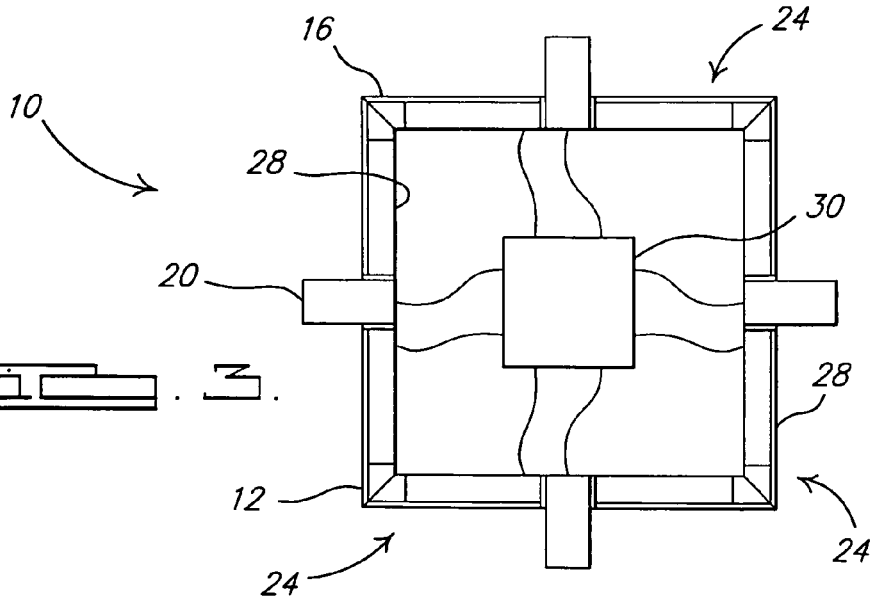
FIG. 3 is a plan sectional view of the traffic detection and signal system of FIG. 1.

Referring to FIGS. 1 through 3, the traffic detection and signal system 10 includes a housing 12 having a base member 14 and sidewalls 16 fixed to the base member 14. The housing 12 is generally rectangular in shape. The housing 12 is not required with respect to the function of the system, but merely serves as a mounting platform on which the other components, to be described, may be secured. Thus, the housing 12 provides for a convenient, self-contained system that is particularly advantageous in applications where it may be seen in all directions leading toward an intersection (I). The specific manner in which the system 10 is positioned is based upon the application. By way of example, in a factory or warehouse environment, the system 10 may be installed by being hung from a ceiling or roof supporting trusses above an intersection (I). Further by way of example, in open-air industrial work environments such as shipping/loading docks or lumberyards, the system 10 may be installed by being mounted on a pole or side of a wall adjacent an intersection (I) or blind corner. In either event, the system 10 may be mounted in a manner to secure the present invention at a location to be visually received by pedestrians and operators of large objects alike.

In applications where large moving objects and pedestrians travel the same pathways (P), the base member 14 may support a reflective dome 18 to provide a reflective visual image of the adjacent pathway (P) or other directions of approaching an intersection (I). The reflective dome 18 is generally hemispherical in shape. It should be appreciated that the reflective dome 18 may be replaced with any structure adapted to provide a visual representation of the adjacent pathway (P) or direction of approaching an intersection (I). It should be appreciated that, in another embodiment, the reflective dome 18 may be an arcuate mirror directed to provide a reflective visual image of the adjacent pathway or other directions that approach an intersection (I).

The traffic detection and signal system 10 further includes at least one, preferably a plurality of sensors 20 to detect objects approaching a pathway intersection (I) within an industrial work environment. As shown in the figures, the sensor 20 is secured to the housing 12 through mounting brackets 22. However, those having ordinary skill in the art will appreciate that, where the housing 12 is not employed, the sensors 20 may be mounted to an area adjacent the intersection (I) by any conventional manner. Also, given the general nature of an industrial work environment, the sensors 20 may be enclosed in a protective container 21. Depending on the actual application of the system 10 the container 21 would posses the appropriate NEMA rating. Generally speaking the container 21 includes a NEMA 4 rating.

Each of the sensors 20 is adapted to sense when a large object, such as a forklift, is approaching an intersection (I). Preferably, the number of sensors 20 corresponds to the number of directions leading toward an intersection (I), to provide for unidirectional sensing. Referring to FIG. 5A, the pathways (P) provide four different directions toward an intersection (I). Accordingly, the traffic detection and signal system 10 includes four sensors 20. It should be appreciated that the system 10 may include any number of sensors 20 positioned to sense any number of directions to approach an intersection (I). By way of example, the system 10 may include two or three sensors 20 where the number of directions to approach an intersection (I) is bi-directional or tri-directional, respectively. It should be appreciated that the sensors 20 may also include a filter (not shown but generally known in the art) to reduce signal interference caused by the surrounding machines and equipment commonly found in an industrial work environment.

Figure 5B:
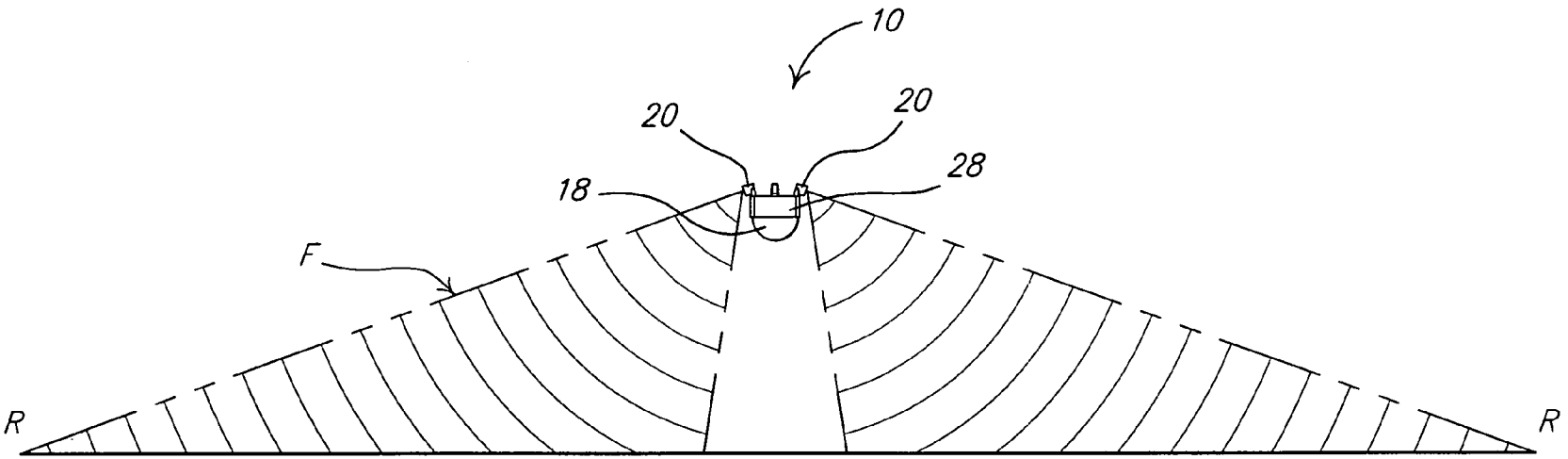
FIG. 5B is an elevational view of the sensor field of detection and signal range of the traffic detection and signal system of FIG. 1.

As illustrated in FIGS. 5A and 5B, the sensors 20 of the system 10 include an adjustable sensing range (R) to sense objects approaching a pathway intersection (I) less than one hundred feet from the location of the sensor in a particular direction. In applications where one hundred feet from the intersection (I) is not required, the sensing range (R) may be reduced to a desired level. The sensors 20 further include an adjustable detection field (F) to distinguish between objects approaching a pathway intersection and objects leaving a pathway intersection. The detection field (F) is also adjustable to detect objects approaching a pathway intersection greater than the size of an average human being. Specifically, the sensors 20 may be adjusted to only detect objects having a size at least larger than an average person so as not to detect a pedestrian approaching an intersection (I). Adjustments of the sensors 20 in both their sensing range (R) and detection field (F) provide for system customization within not only a particular industrial work environment, but also for system customization of a particular intersection (I) within a given industrial work environment. It should be appreciated that, while it may be preferable for the number of sensors 20 to correspond to the number of directions approaching an intersection (I), sensors 20 capable of independently sensing more than one direction may also be employed.

Referring to FIGS. 1 through 3, the system 10 includes at least one, preferably a plurality of visual indicators, generally indicated at 24, to visually indicate that an object is approaching an intersection (I). The visual indicators 24 are a series of lights 26. The lights 26 energize to provide visual indication to a person or operator of a machine that an object is approaching the pathway intersection (I) from another direction. The lights 26 are capable of producing a strobe-effect to capture the attention of persons adjacent the intersection (I). To further facilitate visual indication that an object is approaching the intersection, the lights 26 may include several different colors. The visual indicators may also include signs illuminated by the lights 26 to display indicia to a person adjacent a pathway intersection that an object is approaching the pathway intersection from another direction. It should be appreciated that, while the indicia to be displayed when the lights 26 are illuminated may include any font size and style, for purposes of uniform indicia display throughout an industrial work environment, the indicia displayed by the visual indicators conforms to the ANSI Z535.2-2002 standards.

Similar to the sensors 20, the number of visual indicators 24 corresponds to the number of directions approaching a particular intersection to provide a visual display to all possible persons or objects approaching an intersection (I). When activated, the visual indicators 24 visually indicate the approach of an object in all directions except the direction from which the object is approaching. By way of example, at an intersection (I) having four directions of travel where an object approaches in one direction, the visual indicators 24 will activate with respect to the three remaining directions. It should be appreciated that activation of the visual indicators 24 relative to the direction directly opposite the direction in which the object is approaching the intersection (I) may be redundant since those traveling in this direction may visually acknowledge the presence of the approaching object without the assistance of the system 10. Accordingly, where the application of the system 10 permits, activation of the visual indicators 24 may only include activation of those visual indicators 24 in a direction neither directed toward the same direction as the approaching object nor directly opposite the direction of the approaching object. Further, in situations where more than one object approaches the same intersection (I), all of the visual indicators 24 will activate, thereby notifying the approach of multiple objects toward the same intersection (I).

While the traffic detection and signal system 10 includes a plurality of lights 26 to visually indicate that an object is approaching an intersection (I), those having ordinary skill in the art will appreciate that the present invention may include additional visual indicators 24 to indicate the presence of an object approaching an intersection (I). By way of example, the visual indicators 24 may also include at least one, preferably a plurality of indicia display screens 28 to provide visual indication of a message notifying others adjacent an intersection (I) that an object is approaching the intersection from another direction. The indicia display screens 28 operate in similar fashion to that of the above-described lights 26. Accordingly, the manner in which the lights 26 are activated is incorporated by reference with respect to the indicia display screens 28. The indicia display screens 28 may be liquid crystal display (LCD) or a series of light emitting diodes (LED) or the like, suitable for use within the environment the system 10 is employed.

As illustrated in FIG. 3, both the indicia display screens 28 and the lights 26 are employed as visual indicators 24 operatively engage similar sidewalls 16 of the housing 12. Accordingly, where the housing 12 is employed, the number of sidewalls 16 is preferably equivalent to at least the number of directions toward an intersection (I). Further, as illustrated in FIGS. 1 and 2, the indicia display screens 28 are disposed between the lights 26. It should be appreciated that the location of the indicia display screens 28 relative to the lights 26 may include several different arrangements. By way of example, the lights 24 may be disposed below the indicia display screens 28 or vice versa.

Figure 4:
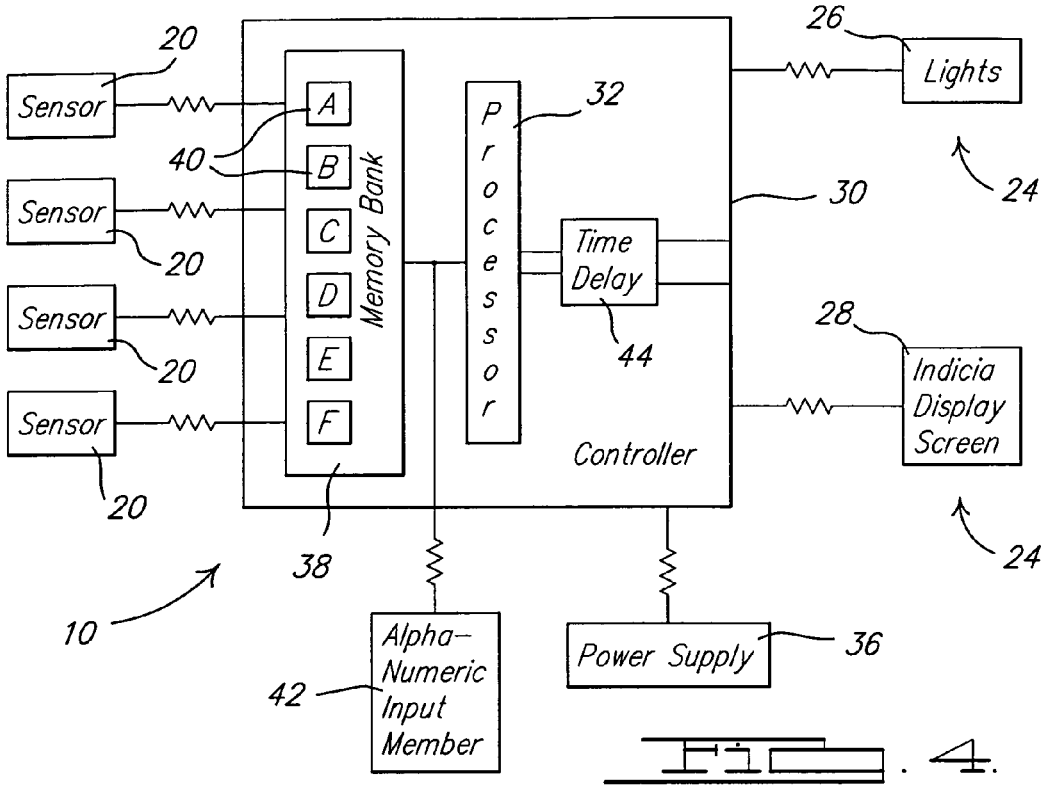
FIG. 4 is a diagrammatic view of an electrical circuit of the traffic detection and signal system of FIG. 1.

Referring to FIGS. 3 and 4, the system 10 further includes a controller 30 electronically coupled to the sensors 20 and the visual indicators 24. The controller 30 includes a processor 32 to receive signals from each of the sensors 20 and transmit signals to each of the visual indicators 24. The controller 30 may be operatively supported by the housing 12 or may be remotely located relative to the housing 12. In those instances where the controller 30 is operatively supported by the housing 12, the sensors 20 may be hardwired to the controller 30 through conductive wiring 34. In instances where the controller 30 is remotely located relative to the housing 12, the sensors 20, and visual indicators 24 may be electronically linked through a radio frequency signal or other "wireless" signal, generally known in the art. It should be appreciated that, while the controller 30 may be remotely located relative to the housing 12 and the sensors 20 operatively supported by the housing 12, the inverse may also be provided; namely, that the controller 30 is operatively secured to the housing 12 and that the sensors 20 are remotely located relative to the housing 12. In either event, the controller 30 is also electrically connected to a power supply 36 which may include connection to an adjacent electrical outlet or a battery or both.

Referring to FIG. 4, the message displayed on the indicia display screens 28 may be pre-programmed or may be programmable by the end user. Accordingly, the controller 30 includes a memory bank 38 having a plurality of memory cells 40 and an input member 42. The input member 42 permits the end user to select a pre-programmed message stored within the memory cells 40 to be displayed when the indicia display screens 28 are energized. To permit the message to be completely programmable by the end user, the input member 42 may include an alphanumeric keypad (not shown but generally known in the art) or similar device that enables the end user to input a series alphanumeric symbols to be displayed on the indicia display screens 28. It should be appreciated that, where programmable indicia display screens 28 are employed, each display screen 28 may be programmed to display a particular message different than that of the other indicia display screens 28.

The controller 30 further includes a time delay 44 to provide transmission of a signal from the controller 30 to the visual indicators 24 for a predetermined amount of time. It should be appreciated that the time delay 44 permits transmission of a signal to the visual indicators 24 for a predetermined amount of time which may either be a factory set time period or may be programmable by the end user through the input member 42 to provide transmission of an activation signal for any length of time deemed appropriate relative to the environment in which the system 10 is employed.

During operation, the traffic detection and signal system 10 senses for moving objects within a predetermined sensing range (R) of the pathway intersection. Once movement is sensed, the sensors 20 detect whether the moving object is approaching a pathway intersection (I) by its movement within a predetermined detection field (F). The sensors 20 may be programmed to detect only objects approaching a pathway intersection (I) that are greater than the size of an average human being. A signal is then received by the controller 30 that an object is approaching the pathway intersection (I) from a first direction. Particularly, the controller 30 receives a signal from a sensor 20 that an object larger than the size of an average human being is approaching the pathway intersection (I) from a first direction.

The controller 30 then transmits a signal to activate the visual indicators 24 positioned toward directions other than the first direction until the moving object is no longer approaching the pathway intersection (I). The transmitted signal energizes the visual indicators 24 to provide a visual indication than an object is approaching a pathway intersection (I) from another direction. Where the controller 30 includes a memory bank 38, upon receipt of a signal from one or more of the sensors 20, the controller 30 transmits a signal to the appropriate indicia display screens 28. The indicia display screens 28 energize to display the selected pre-programmed messages stored within the memory bank 38 or the customized message created by the end user through the alphanumeric input member 42. In this manner, both the lights 26 and the indicia display screens 28 provide a visual display that an object is approaching a pathway intersection (I).

Since the sensors 20 are adjustable, prior to installation, the sensing range is set to a predetermined range (R) suitable for the intended application. Further, each sensor's sensing range may be set to a predetermined range (R) suitable for the particular pathway (P) direction to be sensed. In this manner, the sensing range is not overly broad to sense movement from areas that are not material to a pathway intersection (I), thereby avoiding false positives. At this time, the detection field (F) of the sensors 20 is also set to detect the size of the object approaching a pathway intersection (I) that will activate the transmission of a signal to the controller 30. Further, prior to activation of the system 10 within a particular pathway intersection (I), a time delay 44 (if applicable) is also set to maintain activation of the visual indicators 24 for a predetermined time after the moving object is not longer approaching a pathway intersection (I). The time delay 44 can be generally set for a particular pathway intersection (I) or may be specifically set to maintain activation of each visual indicator 24 positioned toward a particular pathway (P) direction for a particular time.

Accordingly, the present invention monitors and signals movement of objects through pathways with an industrial work environment. Further, the present invention provides sensors 20 that detect the approach of a large moving object toward a pathway intersection (I) to effectively monitor the traffic flow of a particular pathway intersection (I). The present invention also provides visual indicators 24 that visually signal the approach of a large object toward a pathway intersection in directions other than the direction of the approaching object. Further, the present invention further provides a controller that receives a signal from the sensors 20 and transmits a signal to appropriate visual indicators 24 relative to receipt of a signal from a particular sensor 20.

The present invention has been described in an illustrative manner. It is to be understood that the terminology, which has been used, is intended to be in the nature of words of description rather than of limitation.

Many modifications and variations of the present invention are possible in light of the above teachings. Therefore, within the scope of the appended claims, the present invention may be practiced other than as specifically described.

What it is claimed is:

1. A traffic detection and signal system for pathways within an industrial work environment comprising:

at least one sensor positioned to detect objects approaching a pathway intersection within an industrial work environment, said at least one sensor having an adjustable detection field to distinguish between objects approaching a pathway intersection and objects leaving a pathway intersection;

at least one visual indicator electronically linked to said at least one sensor to visually indicate that an object is approaching a pathway intersection from another direction; and a controller electronically coupled to said at least one sensor and said at least one visual indicator, said controller including a processor to receive a signal from said at least one sensor that an object is approaching a pathway intersection and to transmit a signal to activate said at least one visual indicator.

2. A traffic detection and signal system as set forth in claim 1 wherein the adjustable detection field is adjustable to detect objects approaching a pathway intersection greater than the size of an average human being.

3. A traffic detection and signal system as set forth in claim 1 wherein said at least one sensor has an adjustable sensing range to sense objects approaching a pathway intersection less than one hundred feet from the location of said at least one sensor in a particular direction.

4. A traffic detection and signal system as set forth in claim 1 wherein said at least one visual indicator comprises a light capable of producing a strobe-effect to be seen by a person approaching a pathway intersection from a direction other than the direction of the detected object approaching the pathway intersection.

5. A traffic detection and signal system as set forth in claim 4 wherein said at least one visual indicator further comprises a sign illuminated by said light that display indicia to a person approaching a pathway intersection from a direction other than the direction of the detected moving object approaching the pathway intersection.

6. A traffic detection and signal system as set forth in claim 1 wherein said at least one visual indicator comprises an indicia display screen to display a programmed message transmitted by said controller to provide a visual display that a moving object is approaching a pathway intersection.

7. A traffic detection and signal system as set forth in claim 6 wherein said controller includes a memory bank having a plurality of memory cells each including a pre-programmed message and an input member to select a pre-programmed message to be transmitted to said indicia display screen.

8. A traffic detection and signal system as set forth in claim 1 including a plurality of visual indicators and a plurality of sensors corresponding to the number of directions approaching a particular intersection.

9. A traffic detection and signal system as set forth in claim 1 wherein said controller is electronically coupled to said at least one sensor and said at least one visual indicator by radio frequency.

10. A traffic detection and signal system as set forth in claim 1 wherein said controller includes an alpha-numeric input member to input a customized message to be displayed by said at least one visual indicator and said processor processes said customized message to be transmitted to said at least one visual indicator.

11. A traffic detection and signal system as set forth in claim 1 wherein said controller further includes a time-delay to activate said at least one visual indicator for a predetermined time after a moving object exits a pathway intersection.

12. A traffic detection and signal system as set forth in claim 1 further includes a housing having a base member and a plurality of sidewalls fixed to said base member, wherein said at least one visual indicator is operatively supported by said housing.

13. A traffic detection and signal system as set forth in claim 12 wherein said at least one sensor is operatively supported by said housing.

14. A traffic detection and signal system as set forth in claim 12 wherein said controller is operatively disposed within said housing and is electronically coupled to said at least one sensor and said at least one visual indicator by conductive wiring.

15. A traffic detection and signal system for pathways within an industrial work environment comprising:

at least one sensor positioned to detect objects approaching a pathway intersection within an industrial work environment;

at least one visual indicator electronically linked to said at least one sensor to visually indicate that an object is approaching a pathway intersection from another direction;

a controller electronically coupled to said at least one sensor and said at least one visual indicator to receive a signal from said at least one sensor that an object is approaching a pathway intersection and to transmit a signal to activate said at least one visual indicator; and a reflective dome operatively supported by said housing and adapted to provide a reflective visual image of the adjacent pathway or other directions of approaching an intersection.

16. A traffic detection and signal system for pathways within an industrial work environment comprising:

at least one sensor positioned to detect objects approaching a pathway intersection within an industrial work environment;

at least one visual indicator electronically linked to said at least one sensor to visually indicate that an object is approaching a pathway intersection from another direction;

a controller electronically coupled to said at least one sensor and said at least one visual indicator to receive a signal from said at least one sensor that an object is approaching a pathway intersection and to transmit a signal to activate said at least one visual indicator; and at least one arcuately shaped mirror operatively supported by said housing and adapted to provide a reflective visual image of the adjacent pathway or other directions of approaching an intersection.

17. A method for detecting and signaling movement along pathways within an industrial work environment, said method comprising the steps of:

sensing for objects approaching a pathway intersection within a predetermined sensing range with at least one sensor, the at least one sensor having an adjustable detection field to distinguish between objects approaching a pathway intersection and objects leaving a pathway intersection;

detecting an object approaching a pathway intersection within a predetermined detection field;

receiving a signal by a controller including a processor from at least one sensor positioned toward a first direction;

transmitting a signal from the processor of the controller to activate at least one visual indicator positioned toward all directions but the first direction until the object is no longer approaching the pathway intersection; and energizing the at least one visual indicator to provide visual indication in all directions but the first direction until the object is no longer approaching the pathway intersection.

18. A method as set forth in claim 17 including the steps of:

setting the predetermined detection field to detect an object greater than the size of an average human being approaching a pathway intersection;

setting the predetermined sensing pattern to sense objects approaching a pathway intersection within a predetermined sensing range; and setting a time delay to continue to transmit a signal from the controller to the at least one visual indicator that energize the visual indicator for a predetermined length of time after the object is no longer approaching the pathway intersection.

19. A method as set forth in claim 17 including the steps of:

transmitting a signal to an indicia display screen to display one of a plurality of pre-programmed messages within a memory bank of the controller; and energizing the indicia display screen to provide a visual display that an object is approaching a pathway intersection.

* * * * *